US005373967A

United States Patent [19]

Grooms et al.

[11] Patent Number: 5,373,967

[45] Date of Patent: Dec. 20, 1994

[54] SQUEEZEBOTTLE DISPENSER HAVING A CHANNELED VENT VALVE

[75] Inventors: John P. Grooms; Daniel J. Kinne, both of Cincinnati; William P. Dirksing, Cleves; Ronald W. Kock, Wyoming, all of Ohio

[73] Assignee: The Procter & Gamble Company, Cincinnati, Ohio

[21] Appl. No.: 164,117

[22] Filed: Dec. 7, 1993

[51] Int. Cl.[5] ..... B65D 35/28

[52] U.S. Cl. ..... 222/95; 222/209

[58] Field of Search ..... 222/95, 105, 183, 207, 222/209, 212, 213, 386.5, 490, 494, 481, 571

[56] References Cited

U.S. PATENT DOCUMENTS

| | | | |
|---|---|---|---|
| 2,671,579 | 3/1954 | Knoblock | 222/105 |
| 2,743,038 | 4/1956 | Ferries | 222/209 |
| 2,777,612 | 1/1957 | Bensen | 222/209 |
| 3,306,500 | 2/1967 | Williams | 222/209 |
| 4,020,978 | 5/1977 | Szczepanski | 222/209 |
| 4,842,165 | 6/1989 | Van Coney | 222/95 |
| 5,012,956 | 5/1991 | Stoody | 222/94 |
| 5,275,311 | 1/1994 | Piarrat | 222/95 |

FOREIGN PATENT DOCUMENTS

| | | | |
|---|---|---|---|
| 133748 | 6/1991 | Japan | 222/95 |
| 287202 | 2/1965 | Netherlands | 222/209 |

*Primary Examiner*—Andres Kashnikow
*Assistant Examiner*—Philippe Derakshani
*Attorney, Agent, or Firm*—Ronald W. Kock; Kevin C. Johnson

[57] ABSTRACT

A squeezebottle dispenser having an inner flexible bag containing a viscous fluid in fluid communication with a dispensing nozzle. A vent hole is provided in the squeezebottle side wall which is blocked by the user to prevent air from exiting the squeezebottle during squeezing so that air compression within the squeezebottle forces the inner bag to discharge its contents through the dispensing nozzle. When the squeezebottle is released, the vent hole is unblocked in order to vent air into the squeezebottle so that the squeezebottle may return to its unsqueezed shape. The vented air entering an air space located between the squeezebottle and the inner bag replaces the volume of the contents discharged from the inner bag. The addition of a recessed channel, formed between the vent hole and a venting point, which is covered with a compliant film to form an air passage, enables the user to block the vent hole indirectly. When the compliant film is pressed into and against the recessed channel anywhere along the air passage, air cannot escape from inside the squeezebottle, thereby enabling air compression to occur inside the squeezebottle.

18 Claims, 2 Drawing Sheets

SQUEEZEBOTTLE DISPENSER HAVING A CHANNELED VENT VALVE

FIELD OF THE INVENTION

The present invention relates to a resilient squeezebottle dispenser which is suitable for dispensing viscous products such as toothpaste, and more particularly, to a squeezebottle dispenser which includes a vent hole in the squeezebottle side wall to serve as an element of an air vent valve. Even more particularly, the present invention relates to a squeezebottle dispenser wherein air is channeled to a vent hole.

BACKGROUND OF THE INVENTION

Viscous materials, such as toothpaste, are commonly packaged in collapsible tubes which offer the advantages of low cost and ease of use. However, consumer satisfaction with tubes has been limited by their messiness and their poor appearance during use. In addition, tubes can be inconvenient to store because they occupy a large area when laid on their sides.

More recently, mechanical pumps have been introduced with some success because they overcome the negative features of collapsible tubes, and because they occupy less counter and shelf space by virtue of standing upright. However, mechanical pump packages are expensive and they require relatively high forces to dispense viscous products.

The squeezebottle dispenser, disclosed in commonly assigned U.S. Pat. No. 4,842,165 issued to Van Coney on Jun. 27, 1989, has been well received as an alternative to mechanical pumps and collapsible tubes for dispensing toothpaste. The squeezebottle dispenser of Van Coney is marketed as Neat Squeeze TM, which is sold by The Procter & Gamble Company of Cincinnati, Ohio. The upright Neat Squeeze dispenser has all the benefits of mechanical pumps, yet it is less expensive, less messy, and requires lower forces for dispensing toothpaste.

The toothpaste in the Neat Squeeze dispenser is suspended in a thin flexible bag inside an outer squeezebottle. The upper hall of the flexible bag is secured to the interior of the squeezebottle at the shoulder of the squeezebottle and approximately at the midpoint of the squeezebottle in order to facilitate bag inversion as toothpaste is dispensed. When the squeezebottle is squeezed, the volume of air between the bottle and the toothpaste-filled bag is compressed, thereby driving toothpaste from the bag through a nozzle located at the uppermost end of the squeezebottle.

A suckback valve is located between the nozzle and the flexible bag to substantially prevent air from entering the flexible bag through the nozzle at the conclusion of each dispensing cycle when the squeezebottle is released. An air vent valve, which is closed during dispensing, is provided in the bottom of the squeezebottle to vent air to the inside of the squeezebottle to enable the squeezebottle to expand to its unsqueezed shape after dispensing.

The air vent valve of the Neat Squeeze dispenser is a flap of compliant material spot-bonded inside and around one or more vent holes of the squeezebottle's flat bottom. The vent holes are scaled by the flap when pressure is suddenly developed within the squeezebottle. When the bottle is released and a negative pressure develops as the resilient bottle attempts to return to its unsqueezed shape, the flap lifts and air enters the bottle via the vent holes and the spaces between spot bonds. The flap style vent valve is reliable, but it is also relatively expensive due to the need to handle small pieces of flimsy film during assembly.

Prior an shows simpler resilient squeezebottle dispensers having unrestricted holes in the side walls, which are manually closed by the user when squeezing the bottle. That is, a finger or thumb is placed over the hole during squeezing to prevent air from escaping. When released, the hole serves as a vent to allow air into the bottle. Such vents are inexpensive, but have the disadvantage of requiring the bottle to be held in a certain manner for actuation.

A desirable feature of squeezebottle dispensers having inner bags is refill capability. One approach to refilling is to inject product through an opened or removed suckback valve and into a collapsed bag housed within a squeezebottle. The bag is expanded to its full condition, and the suckback valve is closed or reinstalled after the product injecting tube is removed. However, this refilling approach requires the ability to rapidly vent air from between the squeezebottle and the bag as the bag expands. The flap style vent valve of the Neat Squeeze dispenser will not permit air to rapidly vent from the squeezebottle. A centrally located thumb or finger-covered hole in the bottle side wall will permit air to vent out of a squeezebottle only until the inner bag expands enough to block the hole. Thus, neither of the above-described vent valve alternatives are appropriate for this particular refill approach.

An object of the present invention is to provide a squeezebottle dispenser having a vent valve with the simplicity of an open hole in the squeezebottle side wall combined with the reliability of the more expensive film checkvalve.

Another object of the present invention is to provide a squeezebottle dispenser having a remotely located, normally open to atmosphere, vent valve which will permit refilling the flexible bag while it remains within the squeezebottle.

SUMMARY OF THE INVENTION

In practicing the present invention, one preferred embodiment is a squeezebottle dispenser having an inner flexible bag containing a viscous product in fluid communication with a dispensing nozzle. The squeezebottle includes an air space between the inner flexible bag and the squeezebottle. The squeezebottle has a resilient side wall and a base. The resilient side wall has a recessed channel on its exterior side. The recessed channel has an exposed end and a covered end. The covered end of the recessed channel has a vent hole providing fluid communication between the air space and the recessed channel. The squeezebottle dispenser has a compliant film overlaying a portion of the recessed channel to form an air passage from the vent hole in the covered end to the exposed end of the recessed channel. The compliant film is resiliently deformable such that when a manual squeezing force is applied to the resilient side wall of the squeezebottle dispenser, the compliant film is pressed against the recessed channel at a location between the vent hole and the exposed end of the recessed channel to seal the air passage, thereby allowing superatmospheric pressure to develop in the air space between the inner flexible bag and the squeezebottle.

In this preferred embodiment the vent hole is positioned remote from the inner flexible bag so that the vent hole cannot be blocked by the inner flexible bag when the vent hole vents air from the air space as the inner flexible bag is refilled.

In this embodiment the nozzle is secured to the squeezebottle dispenser. The nozzle has an orifice and a suckback valve. The suckback valve is positioned between the orifice and the inner flexible bag so that when the squeezebottle is squeezed, fluid is discharged from the inner flexible bag through the suckback valve and the orifice. However, when the squeezebottle is released, the suckback valve is closed, thereby preventing air from entering the inner flexible bag from the orifice.

The recessed channel of this embodiment may be oriented substantially upright when the squeezebottle dispenser is standing upright on the base, or it may have a spiral shape, or it may be helically or circumferentially wrapped around the resilient side wall of the squeezebottle.

In a second preferred embodiment of the present invention a squeezebottle dispenser, having an inner flexible bag containing a viscous product, comprises a squeezebottle which has an air space located between the inner flexible bag and the squeezebottle. The squeezebottle also has a recessed channel. The recessed channel has a vent hole which provides fluid communication between the air space and the recessed channel. A compliant film overlaying all of the recessed channel has an aperture located over the recessed channel remote from the vent hole to form an air passage within the recessed channel from the vent hole to the aperture. The compliant film is resiliently deformable into the recessed channel such that when a manual squeezing force is applied to the squeezebottle dispenser, the compliant film is pressed against the recessed channel at a location between the vent hole and the aperture to seal the air passage, thereby allowing superatmospheric pressure to develop in the air space.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
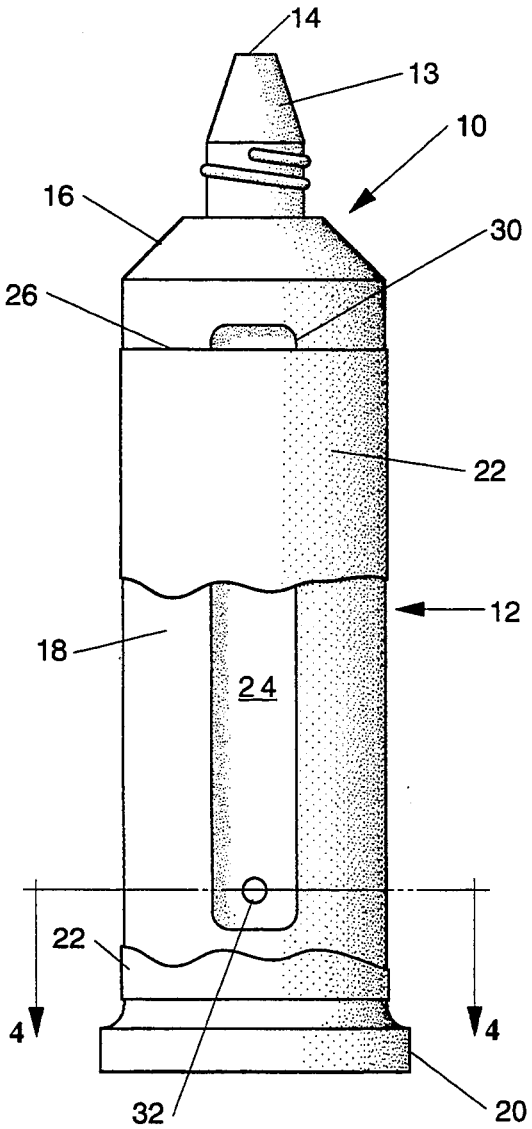
FIG. 1 is a front elevation view of a first preferred embodiment of the squeezebottle dispenser having a channeled vent valve of the present invention, disclosing a compliant film covering all of a channel except for an exposed portion above the upper edge of the film.
Figure 2:
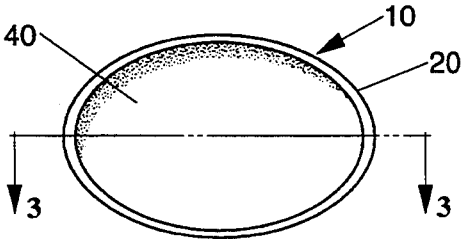
FIG. 2 is a bottom plan view of the squeezebottle dispenser of FIG. 1, showing an oval dispenser cross-section.

Referring now to the drawings, and more particularly to FIG. 1, there is shown a first preferred embodiment of the present invention for a squeezebottle dispenser, generally indicated as 10. The squeezebottle dispenser 10 has an upright, squeezebottle 12, which preferably has an oval cross-section, as shown in FIG. 2. At the uppermost end of squeezebottle 12 is a dispensing nozzle 13. Nozzle 13 has an orifice 14 at its uppermost end. Nozzle 13 is secured to a semi-rigid shoulder 16 of squeezebottle 12. Below shoulder 16 is a resilient side wall 18 of squeezebottle 12. At the lowermost end of squeezebottle 12 is a semi-rigid flared base 20. Wrapped around the resilient side wall 18 of squeezebottle 12 is a compliant film 22, which partially covers an upright recessed channel 24 in the exterior surface of straight-walled body 18. Compliant film 22 is preferably a label, which has an uppermost edge 26. Recessed channel 24 has a covered end 28 and an exposed end 30. Exposed end 30 preferably extends above the uppermost edge 26 of the compliant film 22. Near the bottom of covered end 28 of recessed channel 24 is a vent hole 32, which is in fluid communication with the inside of squeezebottle 12. A portion of compliant film 22 is shown missing so that covered end 28 and vent hole 32 can be seen.

Figure 3:
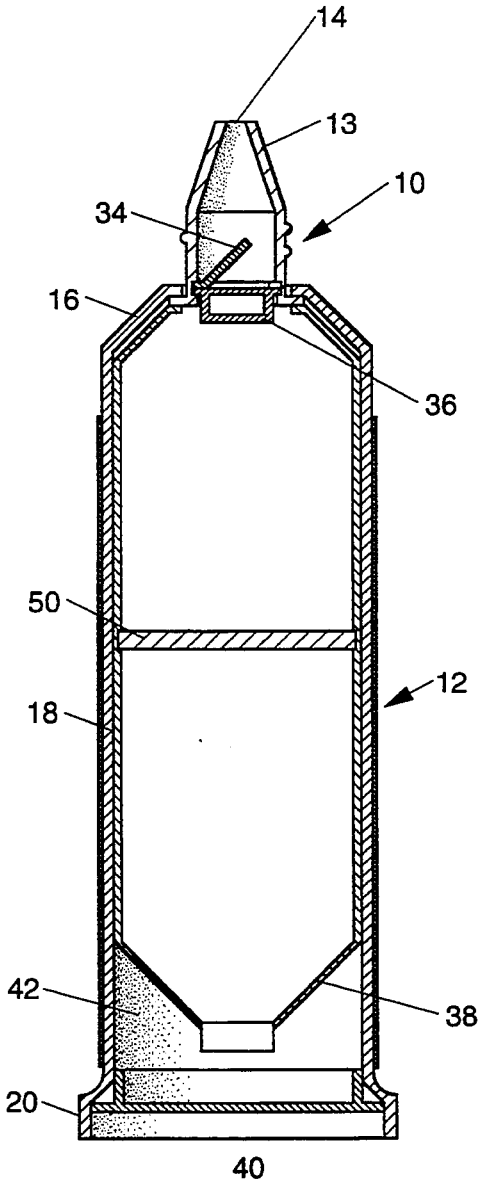
FIG. 3 is a sectioned front elevation view, taken along section lines 3—3 of FIG. 2, disclosing a product-containing, flexible bag suspended inside a squeezebottle.

FIG. 3 shows the inside of squeezebottle dispenser 10. Within dispensing nozzle 13 is a suckback flapper valve 34 and valve seat 36. Flapper valve 34 is shown hinged open from one side. However, flapper valve 34 is normally closed against valve seat 36. Suspended from the inside of squeezebottle 12 is a thin flexible inner bag 38 filled with product. Thin flexible bag 38 is made of deformable film. It is sealed to the shoulder 16 and to the interior wall of squeezebottle 12 at its midpoint 50. Flexible inner bag 38 is in fluid communication with orifice 14 when valve 34 is open. At base 20 is a baseplate 40 connected in an air-tight manner to base 20 of squeezebottle 12. Between baseplate 40 and inner bag 38 is an air space 42.

With the exception of the recessed channel 24 with vent hole 32 covered by compliant film 22, the construction of squeezebottle dispenser 10 is generally in accordance with the teachings of commonly assigned U.S. Pat. No. 4,842,165 issued to Van Coney on Jun. 27, 1989, which is hereby incorporated by reference. However, the baseplate of Van Coney includes a checkvalve to vent air to the air space located between the inner bag and the squeezebottle. Baseplate 40 of the present invention has no checkvalve. Alternatively, channel 24, vent hole 32, and film 22 together function as a checkvalve when a user presses film 22 into and against channel 24 as the resilient side wall 18 of squeezebottle 12 is squeezed.

To dispense product from the squeezebottle dispenser 10, a manual squeezing force is applied to the resilient side wall 18. The force may be applied at any point on the side wall when the inner bag 38 is full. Because the full inner bag nearly fills squeezebottle 12, any inward deflection of side wall 18 will reduce the volume inside squeezebottle 12 and cause side wall 18 to press against inner bag 38. Such volume reduction forces product to be displaced from inner bag 38 and discharged through discharge orifice 14. When the squeezebottle is released, open vent hole 32 allows air to vent into the air space 42 located between squeezebottle 12 and inner bag 38 so that the squeezebottle may return to its unsqueezed shape. The vented air entering air space 42 replaces the volume of the product discharged from the bag. Air cannot be sucked back into the bag at orifice 14 because the suckback valve closes when the squeezebottle is released. The resiliency of the squeezebottle generates a vacuum in the bottle when the bottle is released. The vacuum first draws some product back into the orifice. This small reverse flow of viscous product helps to close and seal the suckback valve.

However, when inner bag 38 is partially empty, deflection of side wall 18 may no longer directly displace product from inner bag 38. The fliud product may have sufficient room within partially empty inner bag 38 to conform to the reduced squeezebottle volume without being displaced. therefore, in the partially empty inner bag condition, squeezing the resilient side wall 18 also requires the compression of air located in the air space 42 between the inside of the squeezebottle 12 and the inner bag 38 in order to force the inner bag to discharge its contents through discharge orifice 14. Vent hole 32 must be closed to enable air compression to occur. As with the full inner bag condition, when the squeezebottle is released, the vent hole must be open in order to vent air into air space 42 so that the squeezebottle may return to its unsqueezed shape.

Some prior art squeezebottle dispensers include a manually coverable vent hole as the vent valve. The vent hole must be placed so that the user's finger or thumb can easily cover it when the user's hand grips the squeezebottle and squeezes it. For different hand sizes and methods of gripping, it is difficult to find a hole location that is always coverable so that the squeezebottle dispenser works reliably. The addition of a recessed channel, formed between the vent hole and a venting point, which is covered with a compliant film to form an air passage, enables the user to block the vent hole indirectly. When the compliant film is pressed against the recessed channel anywhere along the air passage, air cannot escape from inside the squeezebottle. Pressing the film against the channel anywhere along the channel is less exacting than pressing against a hole. That is, a larger target is available for closing the vent hole via the channel.

Figure 4:
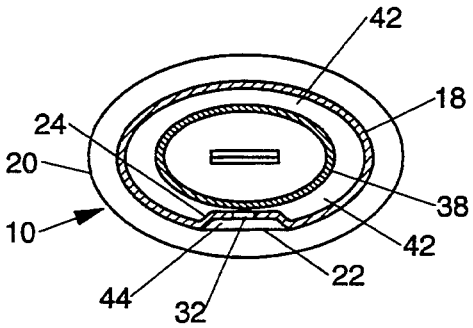
FIG. 4 is a sectioned top plan view, taken along section lines 4—4 of FIG. 1, showing a recessed channel in the squeezebottle side wall with a compliant film spanning across the recessed channel and a vent hole through the bottom of the channel to the inside of the squeezebottle.

FIG. 4 shows a sectioned view of squeezebottle dispenser 10, taken along section line 4—4 of FIG. 1, looking downward at a cross-section through vent hole 32. Vent hole 32 is preferably located near the bottom of squeezebottle 12 so that it is remote from inner bag 38. If bag 38 were refilled from opened suckback valve 34, the bag could easily expand as it is filled without ever blocking vent hole 32. During refilling it is important that air in the air space between squeezebottle 12 and inner bag 38 be permitted to escape through vent hole 32 as bag 38 expands.

FIG. 4 shows the preferred shape and location of recessed channel 24 and vent hole 32 at the covered end 28 of recessed channel 32. The shape of recessed channel 24 is shallow to minimize the compliance necessary for film 22 to be pressed to the bottom of channel 24. Channel 24 is also shaped to be wide enough that the tip of a user's digit fits into the channel, enabling complete closing of the channel as film 22 is manually pressed into channel 24 when the squeezebottle is squeezed. Channel 24 is as long as practical to maximize the target available for closing the vent hole.

The location of recessed channel 24 on resilient side wall 18 of the squeezebottle is preferably where a user places his/her thumb or fingertips when squeezing the squeezebottle dispenser 10. The squeezebottle 12 is shaped with an oval cross-section which is designed to be repeatedly held and so that it can be easily squeezed against the widest sides of body 18. In this preferred gripping orientation, the forces required to squeeze the dispenser tend to be the lowest. Channel 24 is preferably centered on a widest portion of side wall 18 so that fingertips will preferentially engage it whenever the squeezebottle 12 is squeezed.

In FIG. 4 the compliant film 22 is shown spanning across the recessed channel 24, thereby creating an air passage 44 wherever the channel 24 is covered. In the embodiment illustrated the venting point for air passage 44 is at the exposed end 30 of channel 24.

Figure 5:
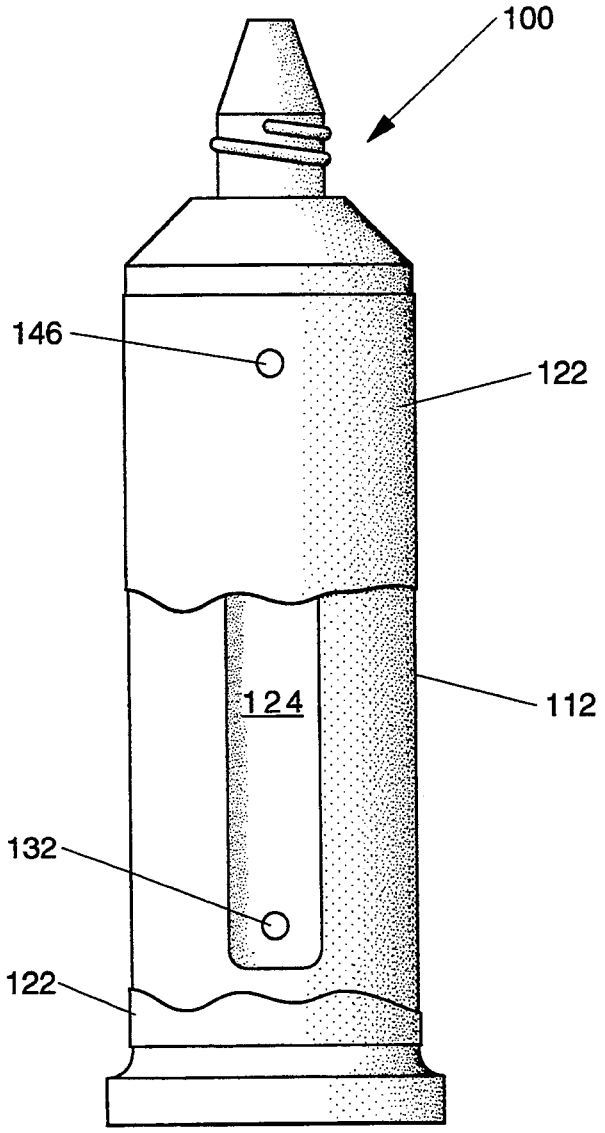
FIG. 5 is a front elevation view of a second preferred embodiment of the squeezebottle dispenser having a channeled vent valve of the present invention, disclosing a compliant film covering all of a channel and having an aperture at the the end of the channel opposite the end where a vent hole is located.

FIG. 5 shows a second preferred embodiment of the present invention for a squeezebottle dispenser, generally indicated as 100. Embodiment 100 is identical to embodiment 10, having a squeezebottle 112 with recessed channel 124 and vent hole 132, except that embodiment 100 has a compliant film 122 which covers the entire recessed channel 124. In order to vent air to recessed channel 124 an aperture 146 is placed in the compliant film 122 at the end of channel 124 opposite the end having vent hole 132. The air passage, not shown, which is capable of being closed by pressing the film 122 into and against recessed channel 124 therefore extends from vent hole 132 to aperture 146. This embodiment enables a larger amount of the surface of squeezebottle 112 to be covered with film 122 than if one end of channel 124 had to remain uncovered. Since flexible film 122 is likely to also serve as a label, larger label surface area may be desirable.

Other alternative constructions of the channelled vent valve of the present invention include a spiral-shaped channel which provides a larger target for pressing compliant film into a channel than a straight channel provides. Other channel shapes within the scope of this invention include helical and circumferential channels extending all the way around the side wall of the squeezebottle. A channel may be formed either by creating a recess in a squeezebottle exterior surface or by creating two parallel raised ribs, across which a film may be stretched, forming a channel between them.

In a particularly preferred embodiment of the present invention, the construction of squeezebottle dispenser 10 is as follows: The squeezebottle 12 is blow molded from a low or linear low density polyethylene with a wall thickness of about 0.05 inches (1.27 mm). The channel 24 is formed by having a raised portion 0.004 to 0.012 inches (0.102 mm to 0.305 mm) in thickness on the inner surface of the blow mold. With such a shallow channel, stripping the squeezebottle axially from the mold is no problem. The length of the upright channel 24 is about 4 inches (101.6 mm) when the straight-walled body 18 is about 4.5 inches (114.3 mm) in height. The channel 24 is 0.3 inches (7.62 mm) wide. The major axis of the oval cross-section of squeezebottle 12 is 2.122 inches (53.9 mm) and the minor axis is 1.413 inches (35.9 mm). The vent hole 32 is formed in the channel by drilling or punching as the part is trimmed after removal from the mold. The vent hole diameter is preferably 0.085 inches (2.16 mm).

The compliant label film 22 is a wraparound thin film of low density polyethylene, about 0.005 inches (0.127 mm) thick. It extends from about 0.25 inches (6.35 mm) below the channel 24 and to within 0.15 inches (3.81 mm) from the top of the channel, so that a small portion of the channel remains exposed. The film 22 is adhesively bonded to the straight-walled body 18 of squeezebottle 12. However, where the film covers the channel, no adhesive is allowed. Since the adhesive is normally applied to the film label 22, another strip of film can be placed over the adhesive on film label 22 to deactivate the adhesive at the channel. Alternatively, a film label 22 could have a non-glued portion registered with the channel during label application.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A squeezebottle dispenser having an inner flexible bag containing a viscous product in fluid communication with a dispensing nozzle, said squeezebottle dispenser comprising:

a) a squeezebottle including an air space between said inner flexible bag and said squeezebottle, said squeezebottle having a resilient side wall and a base, said resilient side wall having a recessed channel, said recessed channel having an exposed end and a covered end, said covered end having a vent hole providing fluid communication between said air space and said recessed channel; and b) a compliant film overlaying a portion of said recessed channel to form an air passage from said vent hole in said covered end to said exposed end of said recessed channel, said compliant film being resiliently deformable such that when a manual squeezing force is applied to said resilient side wall of said squeezebottle dispenser, said compliant film is pressed against said recessed channel at a location between said vent hole and said exposed end of said recessed channel to seal said air passage, thereby allowing superatmospheric pressure to develop in said air space.

2. The squeezebottle dispenser of claim 1 wherein said vent hole is positioned remote from said inner flexible bag such that said vent hole cannot be blocked by said inner flexible bag in order that said vent hole may vent air from said air space when said inner flexible bag is refilled.

3. The squeezebottle dispenser of claim 1 wherein said recessed channel is oriented substantially upright when said squeezebottle dispenser is standing upright on said base.

4. The squeezebottle dispenser of claim 1 wherein said recessed channel has a spiral shape.

5. The squeezebottle dispenser of claim 1 wherein said recessed channel is helically wrapped around said resilient side wall of said squeezebottle dispenser.

6. The squeezebottle dispenser of claim 1 wherein said recessed channel is circumferentially wrapped around said resilient side wall of said squeezebottle dispenser.

7. A squeezebottle dispenser having an inner flexible bag containing a viscous product, said squeezebottle dispenser comprising:

a) a squeezebottle including an air space between said inner flexible bag and said squeezebottle, said squeezebottle having a resilient side wall and a base, said resilient side wall having a recessed channel, said recessed channel having a vent hole providing fluid communication between said air space and said recessed channel; and b) a compliant film overlaying all of said recessed channel, said compliant film having an aperture located over said recessed channel remote from said vent hole to form an air passage within said recessed channel from said vent hole to said aperture, said compliant film being resiliently deformable into said recessed channel such that when a manual squeezing force is applied to said resilient side wall of said squeezebottle dispenser, said compliant film is pressed against said recessed channel at a location between said vent hole and said aperture to seal said air passage, thereby allowing superatmospheric pressure to develop in said air space.

8. The squeezebottle dispenser of claim 7 wherein said vent hole is positioned remote from said inner flexible bag such that said vent hole cannot be blocked by said inner flexible bag in order that said vent hole may vent air from said air space when said inner flexible bag is refilled.

9. The squeezebottle dispenser of claim 7 wherein said recessed channel is oriented substantially upright when said squeezebottle dispenser is standing upright on said base.

10. The squeezebottle dispenser of claim 7 wherein said recessed channel has a spiral shape.

11. The squeezebottle dispenser of claim 7 wherein said recessed channel is helically wrapped around said resilient side wall of said squeezebottle dispenser.

12. The squeezebottle dispenser of claim 7 wherein said recessed channel is circumferentially wrapped around said resilient side wall of said squeezebottle dispenser.

13. A squeezebottle dispenser having an inner flexible bag containing a viscous product, said squeezebottle dispenser comprising:

a) a squeezebottle including an air space between said inner flexible bag and said squeezebottle, said squeezebottle having a resilient side wall and a base, said resilient side wall having a recessed channel, said recessed channel having an exposed end and a covered end, said covered end having a vent hole providing fluid communication between said air space and said recessed channel;

b) a compliant film overlaying a portion of said recessed channel to form an air passage from said vent hole in said covered end to said exposed end of said recessed channel, said compliant film being resiliently deformable such that when a manual squeezing force is applied to said resilient side wall of said squeezebottle dispenser, said compliant film is pressed against said recessed channel at a location between said vent hole and said exposed end of said recessed channel to seal said air passage, thereby allowing superatmospheric pressure to develop in said air space; and c) a nozzle secured to said squeezebottle dispenser in fluid communication with said inner flexible bag, said nozzle having an orifice and a suckback valve, said suckback valve positioned between said orifice and said inner flexible bag so that when said squeezebottle is squeezed, fluid is discharged from said inner flexible bag through said suckback valve and said orifice, but when said squeezebottle is released, said suckback valve is closed, thereby preventing air from entering said inner flexible bag from said orifice.

14. The squeezebottle dispenser of claim 13 wherein said vent hole is positioned remote from said inner flexible bag such that said vent hole cannot be blocked by said inner flexible bag in order that said vent hole may vent air from said air space when said inner flexible bag is refilled.

15. The squeezebottle dispenser of claim 13 wherein said recessed channel is oriented substantially upright when said squeezebottle dispenser is standing upright on said base.

16. The squeezebottle dispenser of claim 13 wherein said recessed channel has a spiral shape.

17. The squeezebottle dispenser of claim 13 wherein said recessed channel is helically wrapped around said resilient side wall of said squeezebottle dispenser.

18. The squeezebottle dispenser of claim 13 wherein said recessed channel is circumferentially wrapped around said resilient side wall of said squeezebottle dispenser.

* * * * *